United States Patent [19]

Evans

[11] 4,094,329

[45] June 13, 1978

[54] APPARATUS FOR WASHING AND SANITIZING CONTAINERS

[76] Inventor: Grover C. Evans, P.O. Box 1124, Little Rock, Ark. 72203

[21] Appl. No.: 801,165

[22] Filed: May 27, 1977

[51] Int. Cl.[2] ..... B08B 3/02

[52] U.S. Cl. ..... 134/56 R; 134/60; 134/70; 134/152

[58] Field of Search ..... 134/56 R, 60, 70, 152

[56] References Cited

U.S. PATENT DOCUMENTS

| | | | |
|---|---|---|---|
| 1,655,954 | 1/1928 | Herold | 134/60 |
| 1,681,839 | 8/1928 | Breton | 134/60 UX |
| 3,308,838 | 3/1967 | Nolte | 134/70 |
| 3,854,445 | 12/1974 | Stolle et al. | 134/152 X |
| 3,896,828 | 7/1975 | Foster et al. | 134/60 X |

FOREIGN PATENT DOCUMENTS

| | | | |
|---|---|---|---|
| 479,142 | 2/1938 | United Kingdom | 134/56 R X |

*Primary Examiner*—Robert L. Bleutge
*Attorney, Agent, or Firm*—McCaleb, Lucas & Brugman

[57] ABSTRACT

Endless, movable, horizontal conveyor moves containers successively past sprays in treatment zones comprising pre-wash, wash, pre-rinse, primary rinse, and final or secondary rinse zones, between adjacent loading and unloading zones. Fresh water is sprayed in the final rinse zone and collected in a rinse liquid reservoir with liquid sprayed in the primary rinse zone. Used rinse liquid from the rinse liquid reservoir is reused in the primary rinse zone where it is recycled back to the rinse liquid reservoir, after which it is reused still again in both the pre-wash and pre-rinse zones before being drained from the machine. Hot sanitizing caustic solution is recycled between a sanitizing solution reservoir and the wash zone. Make-up liquid for the sanitizing solution reservoir is provided from the rinse liquid reservoir through a level responsive valve.

8 Claims, 7 Drawing Figures

20
22
24
88
42
44
74
74
50
30
26
90

190
193
RINSE LIQUID RESERVOIR
186
196
194
P
198
200
212
202
I LOAD
II PRE-WASH
III WASH
IV DRAIN
V PRE-RINSE
VI PRIMARY RINSE
VII FINAL RINSE
VIII UNLOAD
IN
OUT
74
74
160
118
170
164
178
RECYCLE

FRESH WATER
DRIVE SPROCKET
30
UNLOADING ZONE VIII
LOADING ZONE I
FINAL RINSE ZONE VII
PRIMARY RINSE ZONE VI
PRE-RINSE ZONE V
PRE-WASH ZONE II
WASH ZONE III
IDLER SPROCKET
32
DRAIN
DAM 177
DAM 165
DAM 163
DRAIN OFF AREA IV
heater

APPARATUS FOR WASHING AND SANITIZING CONTAINERS

BACKGROUND OF THE INVENTION

In restaurants, bars and the like, soft drink beverages are generally made on the premises as required by mixing carbonated or non-carbonated water with syrup concentrates supplied in tank or jug containers. These containers are returned when empty to the supplier who must wash and sanitize them before refilling them. This is done by spraying them inside and outside, first with heated caustic or other sanitizing solution, and second by rinsing them with water. In conventional apparatus, rinsing operations have not been as efficient as they should be in maximizing the benefit of the rinse water used.

SUMMARY OF THE INVENTION

It is a general object of the present invention to provide apparatus for washing and sanitizing containers.

An important object of the invention is to improve the utilization of rinse water by progressively reusing it a number of times on containers having progressively increasing amounts of soil before discarding it to drain.

It is a specific object of the invention to convey the containers successively through a series of treatment zones comprising wash, pre-rinse, primary rinse, and final or secondary rinse zones, spray the containers in the final rinse zone with fresh water, and collect the liquids from the primary and final rinse zones and reuse it in the pre-rinse and primary rinse zones.

Another specific object of the invention is to reuse the liquid collected in the primary and final rinse zones in a pre-wash zone and as make-up liquid for the wash zone.

An important feature of the invention, in maximizing utilization of the rinse water, is to collect liquid from the primary and final rinse zones and reuse it again in four other zones, namely: (1) in the primary rinse zone; (2) as make-up liquid in the wash zone; (3) in a pre-wash zone where it is discharged to drain; and (4) in a pre-rinse zone where it is discharged to drain.

Other objects and advantages will be apparent from the following description taken in connection with the accompanying drawings in which:

BRIEF DESCRIPTION OF THE DRAWINGS

Like parts are referred to by like reference characters.

DESCRIPTION OF THE PREFERRED EMBODIMENT

Figure 1:
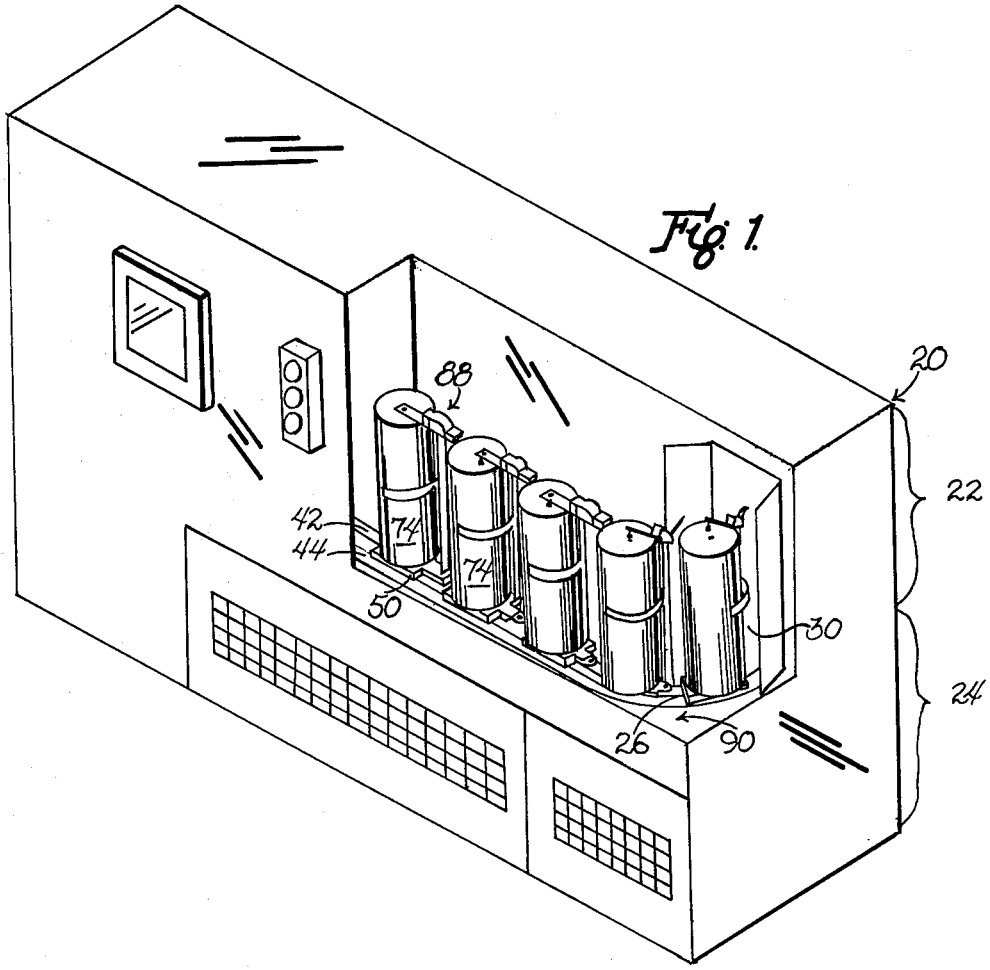
FIG. 1 is an external perspective view of apparatus for washing and sanitizing containers illustrating a preferred embodiment of the invention.

Referring now to the preferred embodiment shown in the drawings, the apparatus includes a housing or enclosure 20 having an upper compartment 22 and a lower compartment 24 separated by an endless conveyor movable along a horizontal orbital path 28 between drive and idler sprockets 30 and 32 respectively.

The conveyor comprises an endless chain 34 with pivotally connected links 36 and a series of rollers 38 guided within a slot 40 between horizontal slide plates 42, 44 mounted along the front of the housing, and 46, 48 mounted along the rear of the housing. The chain is meshed, in the usual manner, with teeth (not shown) on the sprockets. A number of header blocks 50 are fastened as by pins 52 to the conveyor chain 34, preferably at equal intervals. Each block is generally rectangular and has opposite, parallel, vertical side surfaces 54 and 56 and leading and trailing faces 55 and 57. As shown in FIGS. 3–6, side surface 56 has an elongated inlet port 58 communicating through a hollow space 60 in the header block with an upstanding central pipe 62 having a first spray head means 64 at the top. In addition, the inlet port 58 and space 60 are interconnected through passages 66, 68 with upstanding pipes 70, 72. Second spray head means (not shown but similar to 64) may be provided at the upper ends of pipes 70, 72.

Figures 2, 3, 6:
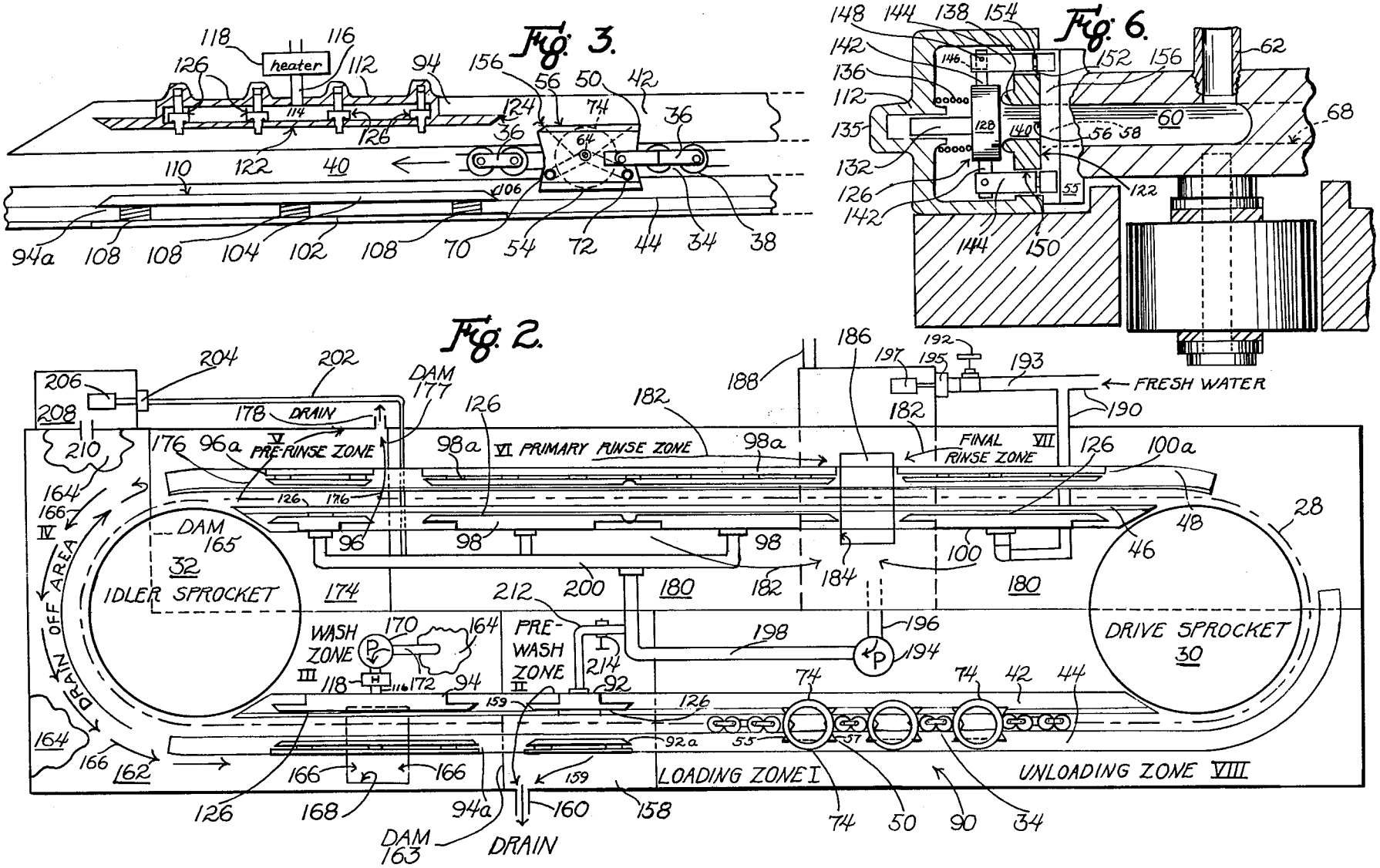
FIG. 2 is a schematic view of the interior of the apparatus shown in FIG. 1 showing an orbitally movable conveyor carrying containers successively through a series of treatment zones, between loading and unloading zones, and showing diagrammatically the flow of rinsing and sanitizing liquids in and out of the individual treatment zones.
FIG. 3 is a fragmentary, enlarged view of FIG. 2.
FIG. 6 is a vertical sectional view of the valve and control, taken along line 6—6 of FIG. 4.

As shown in FIGS. 1–3, cylindrical containers 74 are seated on the blocks 50, upside down, with the central pipe 62 and second spray head 64 extending upward through the open end into the interior, and pipes 70, 72 with similar second spray heads extending upward along the exterior. Thus, when liquid under pressure is directed into inlet port 58, as will be described, it is directed through corresponding first spray head 64 to the interior of the tank and through second spray heads on pipes 70, 72 to the exterior of the tank. The particular positions of the pipes 70, 72 are merely illustrative, and the number and positions may be varied depending upon the shape and size of the container being cleaned.

Figures 4, 5:
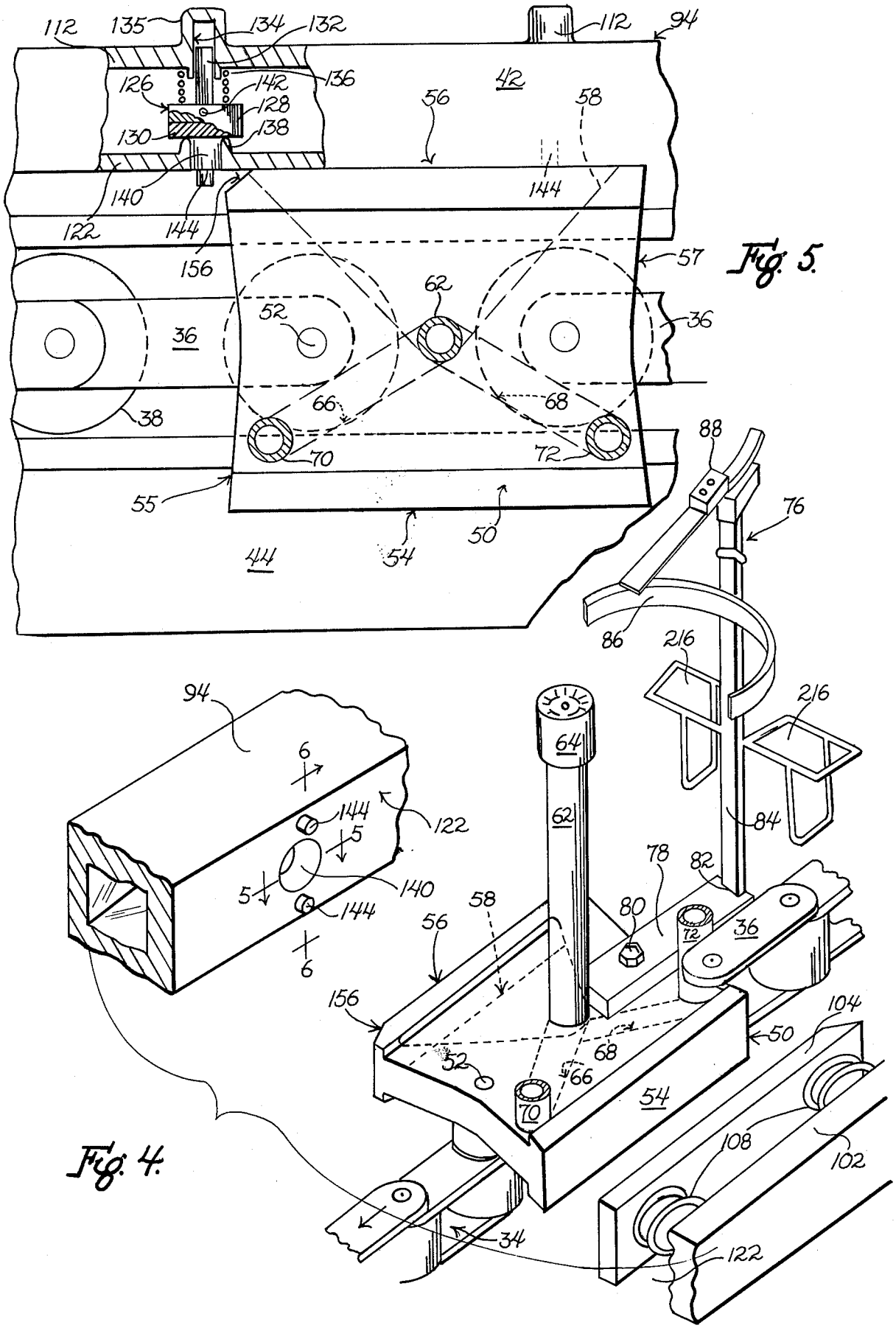
FIG. 4 is a fragmentary, enlarged, exploded, perspective view of FIG. 3.
FIG. 5 is a fragmentary, enlarged view of FIG. 3, showing details of one of the manifold control valves and actuating means for it.

Each container 74 will be held in place on a header block 50 by clamp and guide means generally designated 76 as best shown in FIG. 4. This consists of a horizontal bar 78 extending rearwardly from the block and held by bolt 80. Upstanding from the end of the bar, and affixed as by welding at 82 is a vertical post 84. An arcuate strap 86 is fastened intermediate the ends of the channel to embrace the outside of the cylinder, and a manually releasable spring clamp 88 is adjustable to press against the end of the cylinder to hold it down against the header block while being conveyed through the apparatus. Three such clamps in closed position are shown in the loading zone in FIG. 1 and other clamps are shown in opened condition in the unloading zone.

The apparatus 20 has a table section 90. Containers 74 are mounted on the conveyor header blocks 50 in loading zone I and the conveyor then moves them successively through treatment zones in the upper compartment 22, namely prewash zone II, wash zone III, drain zone IV, pre-rinse zone V, primary rinse zone VI, and secondary or final rinse zone VII. The completely sanitized and fresh-water-rinsed containers are then conveyed to the unloading zone VIII where they are removed from table 90 by the operator. In some variations of the apparatus, the pre-wash zone II may be eliminated and the containers moved direct from the loading zone to the wash zone. An important feature of the apparatus is that the loading and unloading zones are adjacent one another on the table 90. This facilitates use by a single operator.

Liquid-distributing manifolds 92, 94, 96, 98 and 100 are provided in zones II, III, V, VI and VII respectively. These manifolds are illustrated as similar in construction, differing only in their length along the path of the conveyor so as to spray the respective liquids on the conveyors for a corresponding length of time. In one specific example the manifolds 92 and 96 were each 16 inches long, manifolds 94 and 100 were each 28 inches long, and each manifold unit 98 was 28 inches long making a total of 56 inches in the primary rinse zone.

Opposite each manifold is a pressure plate means. These being designated 92*a*, 94*a*, 96*a*, 98*a* and 100*a*. These, like the manifolds, are similar to one another in construction, varying only in length.

Manifold 94, and corresponding pressure plate means 94*a*, and their coaction with each header block 50 passing between them will now be described as examples for the other manifolds and pressure plate means.

Referring to FIG. 3 pressure plate means 94*a* consists of a vertical plate 102 affixed as by welding to the upper side of front slide plate 44. A deflectable pressure plate 104 having a beveled surface 106 is floatably supported on fixed plate 102 by a plurality of compression springs 108. The pressure plate 104 has an inner slide surface 110 at the upstream end engageable with header block side surface 54.

Referring now to the manifold 94, as shown in FIG. 3 and as shown in more detail in FIGS. 4–6, this comprises an elongated casing 112 with an inner space 114 communicating with a pipe 116 leading from heater 118 and pump 170. Each casing 112 has an inner slide surface 122 and a beveled surface 124 at the upstream end opposite corresponding bevel surface 106 on the pressure plate. Inner slide surface 122 engages side surface 56 on the header block.

A series of similar valves 126 are positioned along surface 122. As best shown in FIGS. 5 and 6, each valve comprises a valve disc 128 having a rubber-like washer or disc 130 and an axial stem 132 guided in a cylindrical bore 134 in a hollow boss 135 in the manifold casing 112. The valve disc is urged by a compression spring 136 in a direction to press washer 130 against an annular seat 138 surrounding outlet port 140. As best shown in FIG. 6, the valve disc 128 has a pair of diametrically opposed, radial struts 142 providing connection to parallel actuator rods 144. Each strut 142 is fitted within a bore 146 in the corresponding rod, and held by a pin 148. The actuator rods extend through parallel, machined bores 150 in the casing. O-rings 152, carried in grooves 154 in the rods, provide a fluid seal.

Valve actuator means, now to be described, open the valves 126 successively as each header block 50 moves along each manifold, thereby enabling fluid flow from the outlet ports 140 into the respective passages 60, 66 and 68 within the header blocks. The actuator rods 144 extend beyond the inner slide surface 122 and are engageable by beveled cam surface 156 along the leading end of each header block side surface 56. This cams the actuator rods 144 inward into the manifold, opening the particular valve 126 and allowing liquid to flow from the interior of casing 112, through the outlet port 140, into the space 60 within the header block, and upwardly through vertical pipes 62, 70 amd 72. With a container 74 in position as shown in FIGS. 1, 2 and 3, on each header block, spray head 64 washes the interior of the container, and spray heads (not shown) at the tops of pipes 70 and 72 wash the outside of the container. Surfaces 56 and 122 will preferably be machined quite flat to provide an effective fluid seal when they are pressed together by springs 108 and pressure plate 104. Thus, the valve and valve actuator arrangement described directs fluid from the manifold only when one of the outlet ports 140 is aligned with one of the header block inlet ports 58. The valves remain closed to conserve liquid at all other times.

Referring now particularly to FIG. 2, the loading and unloading zones I and VIII comprise the left and right end portions of the table 90 respectively. In the prewash zone II a drain plate 158 underlies the conveyor and is pitched to convey liquid in a single, once-through pass in the direction of arrows 159 to a drain outlet pipe 160.

In wash zone III and drain zone IV a drain plate 162 underlies the conveyor above a sanitizing solution reservoir 164 and is pitched to drain liquid in the direction of arrows 166 through an opening 168 in the plate. Dams 163 and 165, consisting of upstanding plates, define the entrance to the wash zone III and the exit from the drain zone IV respectively. These confine the sanitizing solution so it is not lost to the adjacent zones. A recirculating pump 170 draws fluid from the reservoir through the pipe 172 and through outlet pipe 116 and heater 118 to the manifold 94. In the pre-rinse zone V a drain plate 174 underlies the conveyor and is pitched to drain liquid in the direction of the arrows 176 in a once-through pass to drain outlet pipe 178. A dam 177, at the exit from the pre-rinse zone V, separates it from the primary rinse zone.

In the primary and secondary rinse zones VI and VII, a drain plate 180 underlies the conveyor and is pitched to convey liquid in the direction of the arrows 182 to an opening 184 leading to a rinse liquid reservoir 186. The latter has an overflow outlet pipe 188 which allows excess liquid in the reservoir to overflow.

Figure 7:
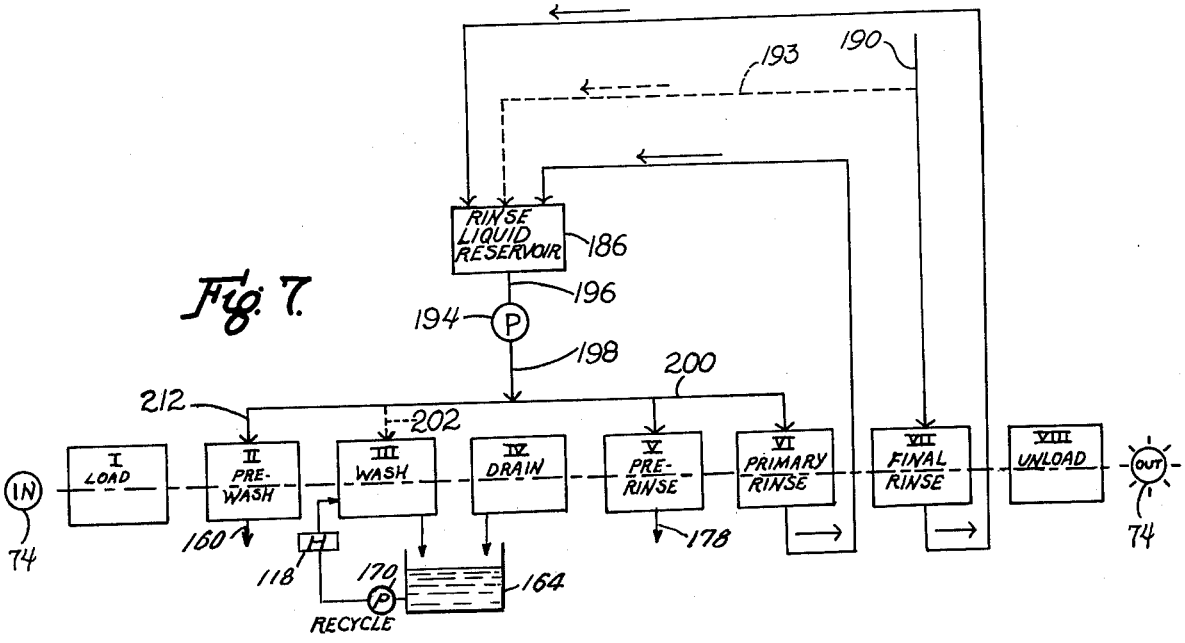
FIG. 7 is a container and liquid flow diagram.

Considering the overall flow of fluids, as shown in FIGS. 2 and 7, fresh water enters a main inlet pipe 190 and, after use in the washing and rinsing zones, is discharged through drain outlet pipes 160 and 178. Flow details will now be described.

Fresh water make-up is supplied through pipes 190, 193 and valve 192 to the rinse liquid reservoir 186 as needed, the level being maintained by a make-up valve 195 controlled by float 197 in tank 186. The control valve 192, may be an electrically actuated solenoid valve if desired. Fresh water flows directly through pipe 190 to manifold 100 and will be directed through valves 126 into header blocks 50 in succession for final spray of the insides and outsides of the containers as they are conveyed through the final or secondary rinse zone VII.

A pump 194 draws liquid from the reservoir 186 through inlet pipe 196 and discharges it through outlet pipe 198 into manifold pipe 200. This distributes liquid into primary rinse manifolds 98, 98 for further recirculation through the pump 194, and to primary rinse manifold 96 for discharge through drain 178. In addition, there is a bypass line 202 which diverts liquid, as needed, to make-up valve 204, controlled by float 206 at an inlet port of caustic tank 208. In this way, some of the fresh water entering through pipe 190, is mixed with caustic and is used in the wash zone III. This keeps the liquid level in the tank 208 at a level determined by the setting of the float. Caustic is added to the tank from time to time as needed to keep the strength of the sanitizing solution in the reservoir 164 at an effective value. An opening 210 in the end wall of the apparatus provides the communication between the caustic tank and the sanitizing solution reservoir. There is some loss of liquid from the wash zone III by reason of carry-over on the wetted containers, which drains off and is discharged through drain 178, plus some evaporation. Hence the line 202 provides make-up liquid from reservoir 186 to keep the level in sanitizing solution reservoir 164 at the proper level.

A pipe 212 containing control valve 214 provides a connection from outlet pipe 198 to pre-wash manifold 92.

An important part of the present invention is that the fresh water admitted to the apparatus through main inlet pipe 190 is used in the secondary or final rinse zone VII, is collected with liquid drained from the primary rinse zone VI in rinse liquid reservoir 186, and then is reused in four separate zones, namely in the caustic tank 208, and in zones II, V and VI. The dams 163, 165 and 177, described above, prevent premature loss of liquids through drains 160 and 178.

Use and operation of the apparatus is believed to be obvious in view of the above. Briefly, tanks or containers 74 are placed on the header blocks 50 and held down by clamps 88 in the loading zone I. Any lids and pertinent hardware may be placed in the brackets 216 attached to the posts 84.

It may not always be necessary to provide a prewash zone II. However, this is desirable if the containers are likely to be severely soiled so that the initial sprays will dislodge soil and solid foreign matter through drain 160. In a typical installation, wash water from manifold 92 may be about 75° F.

Next, in the wash zone III, the sanitizing solution is maintained in the neighborhood of 180° F by the heater 118. As described, it is recirculated by pump 170.

From the time the containers leave wash manifold 94 to the time they reach pre-rinse manifold 96, they pass through a drain-off area IV, the drained liquid being returned to reservoir 164 (which underlies all three zones III, IV and V).

In the pre-rinse zone V the temperature of liquid, recycled from reservoir 186, may be in the neighborhood of 80° F. This removes the last vestige of caustic and soil from the containers, discharging it through the drain 178.

Next, the relatively long primary rinse zone VI provides an extensive rinsing at a temperature in the order of 75° F. As stated, this is returned to the liquid reservoir 186 for reuse in the zones described.

Finally, the pre-rinsed and primarily rinsed containers reach the final or secondary rinse zone VII and are rinsed clean with fresh water at a temperature of 50°–55° F, and are conveyed around the drive sprocket 30 to the unloading zone VIII where the clean, sanitized containers and the lids and appurtenant hardware are removed for reuse.

As stated, the pre-wash zone II may, if desired, be dispensed with. In this case, it may simply be eliminated completely, or in the case of the apparatus disclosed, the valve 214 may be kept closed.

The above described arrangement and method are illustrative of a small number of many possible specific embodiments of the invention. Numerous and varied other arrangements and methods can readily be devised in accordance with the principles disclosed by those skilled in the art without departing from the spirit and scope of the invention.

The embodiments of the invention in which an exclusive property or privilege is claimed are defined as follows:

1. Apparatus for washing and sanitizing containers comprising:

a housing having a plurality of treatment zones comprising: wash, pre-rinse, primary rinse, and final rinse zones disposed successively along a predetermined path between loading and unloading zones;

a conveyor orbitally movable along said path, said conveyor comprising a plurality of container supports each adapted to hold a container in upside down condition for movement successively through said treatment zones;

spray means in each of said treatment zones positioned to spray inside and outside walls of a container on said conveyor;

liquid conduit means connecting the spray means in the final rinse zone to a source of fresh water under pressure;

means for collecting and combining liquid sprayed in both said primary rinse zone and said final rinse zone and directing such combined liquid to a common reservoir;

first pump and conduit means for using rinse water at least a second time by directing it from said common reservoir to the spray means in said pre-rinse and primary rinse zones; and second pump and conduit means for recycling sanitizing solution between a sanitizing solution reservoir and the spray means in the wash zone.

2. Apparatus for washing and sanitizing containers comprising the combination of claim 1 in which said plurality of treatment zones includes a pre-wash zone preceding said wash zone along said conveyor, and said pre-wash zone has spray means positioned to spray inside and outside walls of a container on said conveyor and connected to the outlet of said first pump and conduit means for using rinse water at least a third time by directing it from said common reservoir to the pre-wash zone.

3. Apparatus for washing and sanitizing containers comprising the combination of claim 1 in which said sanitizing solution reservoir has an inlet port for make-up water connected to said first pump and conduit means, and liquid level responsive valve means associated with said inlet port controlling the admission of used rinse water to maintain a predetermined level of liquid in said sanitizing solution reservoir.

4. Apparatus for washing and sanitizing containers according to claim 1 in which said wash and pre-rinse zones are spaced apart along said conveyor to provide a drain zone, and means beneath said drain zone for collecting sanitizing solution drained from said containers and returning it to said sanitizing solution reservoir.

5. Apparatus for washing and sanitizing containers according to claim 1 in which said conveyor is endless and orbitally movable and travels through said treatment zones in a common horizontal plane, and said loading and unloading zones are adjacent one another to facilitate loading and unloading by a single operator.

6. Apparatus for washing and sanitizing containers comprising:

a housing having treatment zones comprising wash, pre-rinse, primary rinse, and final rinse zones disposed successively along a predetermined path between loading and unloading zones;

a conveyor orbitally movable along said path, said conveyor comprising a plurality of container supports each having first spray means upstanding therefrom and movable with said conveyor, each said container support being adapted to hold a container in upside down condition with the corresponding first spray means extending through a container opening and directed toward the inside wall of the container, each said container support having a liquid inlet port connected to said first spray means;

liquid manifold means in each treatment zone along said path having a liquid outlet port registrable with the liquid inlet ports of said container supports while in said treatment zones to guide liquid from the manifold means to the first spray means;

second spray means in each of said treatment zones directed toward the outside wall of a container being moved along said path by said conveyor;

liquid conduit means connecting the second spray means and manifold means of the final rinse zone to a source of fresh rinse water under pressure;

a common reservoir for the primary and final rinse zones;

means for collecting and combining liquid sprayed in both said primary rinse zone and said final rinse zone, and means for directing such collected and combined liquid to said common reservoir;

first pump and conduit means for using rinse water at least a second time by directing it from said common reservoir to the second spray means and to the manifold means in the pre-rinse and primary rinse zones;

a sanitizing solution reservoir;

means for collecting liquid sprayed in said wash zone and directing it to said sanitizing solution reservoir; and second pump and conduit means for recycling sanitizing solution to said sanitizing solution reservoir via the second spray means and the manifold means in said wash zone.

7. Apparatus for washing and sanitizing containers comprising the combination of claim 6 in which said plurality of treatment zones includes a pre-wash zone preceding said wash zone along said conveyor and said pre-wash zone has liquid manifold means and second spray means connected to the outlet of said first pump and conduit means for using rinse water at least a third time by directing it from said common reservoir to the pre-wash zone.

8. Apparatus for washing and sanitizing containers comprising:

a housing having treatment zones comprising separate pre-wash, wash, drain, pre-rinse, primary rinse, and final rinse zones disposed successively along a predetermined path between loading and unloading zones;

a conveyor orbitally movable along said path through said treatment zones in a common horizontal plane, said loading and unloading zones being adjacent one another to facilitate loading and unloading by a single operator, said conveyor comprising a plurality of container supports each having first spray means upstanding therefrom and movable with said conveyor, each said container support being adapted to hold a container in upside-down condition with the corresponding first spray means extending through a container opening and directed toward the inside wall of the container, each said container support having a liquid inlet port with a passage connecting it to the first spray means thereon;

liquid manifold means in each treatment zone along said path having a liquid outlet port registrable with the liquid inlet ports of said container supports while in said treatment zones to guide liquid from the manifold means to the first spray means;

second spray means in each of said treatment zones directed toward the outside wall of a container being moved along said path by said conveyor;

liquid conduit means connecting the second spray means and manifold means of the final rinse zone to a source of fresh rinse water under pressure;

a common reservoir for the primary and final rinse zones;

a sanitizing solution reservoir and means for pumping liquid therefrom into the second spray means and manifold means of the wash zone;

means for collecting and combining liquid sprayed in both said primary rinse zone and said final rinse zone, and means for directing such collected and combined liquid to said common reservoir;

pump and conduit means having its inlet connected to said common reservoir and its outlet connected respectively as follows:

(a) to the second spray means and manifold means in the pre-rinse zone for using rinse water, at least a second time, to remove residual sanitizing solution;

(b) to the second spray means and manifold means in the primary rinse zone for using rinse water, at least a second time, to further remove residual sanitizing solution;

(c) to the second spray means and manifold means in the pre-wash zone, thereby using rinse water at least a third time, for an initial cleaning operation; and (d) to a liquid level responsive valve means associated with an inlet port on said sanitizing solution reservoir controlling the admission of used rinse water to maintain a predetermined liquid level in said sanitizing solution reservoir;

said wash and preliminary rinse zones being spaced apart along said conveyor to provide said drain zone, and means beneath said wash and drain zones for collecting sanitizing solution drained from said containers and returning it to said sanitizing solution reservoir; and drain means for discarding liquid sprayed in both said pre-wash and pre-rinse zones.

* * * * *